US011187197B2

(12) United States Patent
Cabauatan et al.

(10) Patent No.: US 11,187,197 B2
(45) Date of Patent: Nov. 30, 2021

(54) INTERNAL COMBUSTION ENGINES VIA ELECTROMAGNETIC FUEL IONIZATION AND ELECTROSTATIC IONIZATION OF AIR

(71) Applicants: Perlito G. Cabauatan, Bayombong (PH); Patricio R. Cabauatan, Bayombong (PH); Ronald Myers, Munster (AU)

(72) Inventors: Perlito G. Cabauatan, Bayombong (PH); Patricio R. Cabauatan, Bayombong (PH); Ronald Myers, Munster (AU)

( * ) Notice: Subject to any disclaimer, the term of this patent is extended or adjusted under 35 U.S.C. 154(b) by 0 days.

(21) Appl. No.: 17/027,896

(22) Filed: Sep. 22, 2020

(65) Prior Publication Data

US 2021/0088010 A1 Mar. 25, 2021

Related U.S. Application Data

(60) Provisional application No. 62/904,280, filed on Sep. 23, 2019.

(51) Int. Cl.
*F02M 27/04* (2006.01)
*F02M 35/10* (2006.01)

(52) U.S. Cl.
CPC ..... *F02M 27/04* (2013.01); *F02M 35/10249* (2013.01); *F02M 2027/047* (2013.01)

(58) Field of Classification Search
CPC ..... F02M 27/04; F02M 35/10249; F02M 2027/047
See application file for complete search history.

(56) References Cited

U.S. PATENT DOCUMENTS

| | | | | |
|---|---|---|---|---|
| 4,715,325 | A | 12/1987 | Walker | |
| 5,331,807 | A * | 7/1994 | Hricak | F02B 51/04 60/275 |
| 5,460,144 | A * | 10/1995 | Park | F02M 27/045 123/538 |
| 6,063,267 | A * | 5/2000 | Crewson | C02F 1/487 204/554 |
| 2007/0181104 | A1 | 8/2007 | Collins | |
| 2010/0252007 | A1 * | 10/2010 | Gonzales | F02M 35/10019 123/537 |

FOREIGN PATENT DOCUMENTS

| | | | |
|---|---|---|---|
| JP | 2003301748 | 10/2003 | |
| JP | 2003301748 A * | 10/2003 | |
| WO | 2011/122979 | 10/2011 | |
| WO | WO-2011122979 A1 * | 10/2011 | F02M 27/04 |

OTHER PUBLICATIONS

PCT Search Report and Written Opinion for corresponding PCT Application No. PCT/IB2020/058845, dated Feb. 17, 2021.

* cited by examiner

*Primary Examiner* — Jacob M Amick
*Assistant Examiner* — Charles J Brauch
(74) *Attorney, Agent, or Firm* — Gardner, Linn, Burkhart & Ondersma LLP

(57) ABSTRACT

An air/fuel conditioning apparatus for an engine includes an electromagnetic component configured to positively ionize fuel molecules of fuel supplied to the engine. The apparatus further includes an electrostatic component configured to negatively ionize air molecules of air supplied to the engine. The oppositely ionized fuel molecules and air molecules are mixed in a carburetor/fuel injection system of the engine.

20 Claims, 11 Drawing Sheets

Phenolic or Insulating board for needle assembly

Attached to ES pcb (not shown)

Transducer Assembly Steps
(FIG. 5A)
Relay
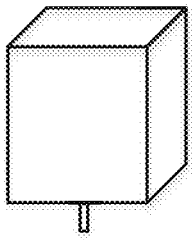
Original
(FIG. 5C)
Main armature removed
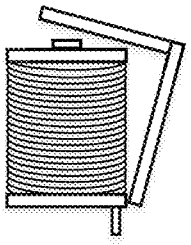
(FIG. 5B)
Modified, casing removed
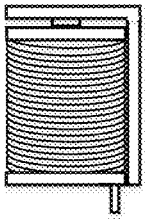
(FIG. 5D)
Solenoid/Coil
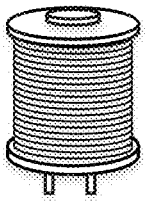

Metal Strip, top view

Metal Strip bent, side view

Solenoid assembled in metal strip, side view

FIG. 9

| Symbol | Description | Circuit Function |
|---|---|---|
| C1 | 3.3 ufd 50v electrolytic cap | Filter Capacitor |
| C2 | 3.3 ufd 50v electrolytic cap | Filter Capacitor |
| C3 | 3.3 ufd 50v electrolytic cap | Filter Capacitor |
| C4 | .022 ufd 2kv capacitor | High Voltage Capacitor |
| C5 | .022 ufd 2kv capacitor | High Voltage Capacitor |
| C6 | .022 ufd 2kv capacitor | High Voltage Capacitor |
| C7 | .05 ufd 50V tantalum capacitor | Timing Capacitor |
| R1 | 1k ohm 1/4w resistor | Timing resistor |
| R2 | 15k ohm1/4w resistor | Timing resistor |
| R3 | 330 ohm 1/4w resistor | Limiting resistor |
| R4 | 2.2 k ohm1/4w resistor | Limiting resistor |
| R5 | 100k 1w resistor | Limiting resistor |
| R6 | 470 ohm 1/4w resistor | Limiting resistor |
| D1 | 1N4007 silicone diode 1A | Rectifier |
| D2 | 1N4007 silicone diode 1A | Rectifier |
| D3 | 1N4007 silicone diode 1A | Rectifier |
| D4 | 1N4007 silicone diode 1A | Rectifier |
| HV xfmr. | xmfr Pri-12vac; sec-220vac; 750ma | Voltage step-up |
| IC1 | 7812 Regulator IC | Voltage regulation |
| IC2 | 555 Timer IC | Oscillator |
| T1 | TIP31 transistor 3A | Voltage amplifier |
| T2 | 2N3055 transistor 10A | Power amplifier |
| LED1 | Light emitting diode – red | Power indicator |
| Needles (5 pcs.) | Large sewing needles | Electrodes |

TABLE I: Electrostatic PCB Parts List

FIG. 10

| Symbol | Description | Circuit Function |
|---|---|---|
| R7 | 10 k ohms, ¼ resistor carbon | Timing resistor |
| R8 | 100 k ohms,1/4 watt resistor carbon | Timing resistor |
| R9 | 330 ohms, ¼ watt carbon resistor | Limiting resistor |
| R10 | 1.2 k ohms, ¼ watt carbon resistor | Limiting resistor |
| R11 | 2.2 k ohms, ¼ watt carbon resistor | Limiting resistor |
| R12 | 2.2 k ohms, ¼ watt carbon resistor | Limiting resistor |
| C8 | 3.3 ufd, 50v electrolytic capacitor | Filtering, de-coupling |
| C9 | 2.2 ufd, 16v tantalum capacitor | Timing capacitor |
| D5 | 1N4007, silicone diode, 1 Amp | Absorbs back emf |
| IC3 | 555 Timer IC | Oscillator |
| T3 | TIP41 transistor, 6 Amp | Power Amplifier |
| LED2 | Light Emitting Diode, red | Light Indicator |
| LED3 | Light Emitting Diode, green | Light Indicator |
| Sa | 100 ohm solenoid | EM inductor |
| Sb | 100 ohm solenoid | EM inductor |

TABLE II: Electromagnetic PCB Parts List

FIG. 11

| Symbol | Description | Circuit Function |
|---|---|---|
| D6 | 1N4007 Silicone Diode 1A | Surge suppressor/Protector |
| D7 | 1N4007 Silicone Diode 1A | Polarity protector |
| C10 | 3.3 ufd 25v Electrolytic Cap | 2nd Filter |
| C11 | 3.3 ufd 50v Electrolytic Cap | 1st Filter |
| IC4 | 7812 Regulator IC | Voltage regulation |

TABLE III: Voltage Regulator PCB Parts List

INTERNAL COMBUSTION ENGINES VIA ELECTROMAGNETIC FUEL IONIZATION AND ELECTROSTATIC IONIZATION OF AIR

CROSS REFERENCE TO RELATED APPLICATIONS

The present application claims the filing benefit of U.S. provisional application Ser. No. 62/904,280, filed Sep. 23, 2019, which is hereby incorporated by reference herein in its entirety.

FIELD OF THE INVENTION

The present invention is directed to internal combustion engines, and in particular to emissions control and fuel economy devices for internal combustion engines.

BACKGROUND OF THE INVENTION

The twin problems of fossil fuel (e.g., petroleum, coal, and natural gas) shortage and air pollution due to the combustion of those fossil fuels have created an increasing demand for high efficiency engines, both to reduce combustion emissions and to reduce the rate of fossil fuel consumption. There have been prior art devices which have been directed to improving engine efficiency. However, most of the prior art devices have had limited success.

SUMMARY OF THE INVENTION

Embodiments of the present invention provide methods and systems for an exemplary fuel and air conditioning apparatus for an internal combustion engine ("engine"), which methods and systems improve engine efficiency by using dual technologies. An aspect of the present invention includes the simultaneous conditioning of both fuel and air particles or molecules. When the two oppositely conditioned fluids (air and fuel in liquid and gaseous form) are mixed in the carburetor/fuel injection system of the engine, a much higher percentage of fuel combustion is achieved, resulting in more fuel savings, higher power, and cleaner exhaust than can be achieved by prior art devices using single technology.

In an aspect of the present invention, an exemplary fuel and air conditioning apparatus includes an electromagnetic component and an electrostatic component. While the electromagnetic component positively ionizes fuel molecules, the electrostatic component negatively ionizes air particles. An electromagnetic transducer of the electromagnetic component is attached to a fuel hose before a carburetor/fuel injection assembly of the engine. Electrostatic electrodes of the electrostatic component are installed inside an air induction system of the engine. In an aspect of the present invention, the electromagnetic component positively ionizes the fuel molecules with a pulsing electromagnetic field in the subsonic region (5-10 Hz) to break down molecular clusters in the fuel, and thereby "atomizing" them. When the fuel molecules are atomized, there will be less unburned fuel in the exhaust. In another aspect of the present invention, the electrostatic component negatively ionizes the air particles by a "corona discharge phenomena." Because air particles are negatively ionized by the negative high voltage on the electrostatic electrodes, (i.e., a voltage equal to or more than −500V), the negatively ionized air particles will tend to repel each other. The opposite polarization of the two elements (air and fuel) will result in a high level of mixing of the air and fuel, resulting in high rates of fuel combustion in the engine.

In a further aspect of the present invention, an exemplary air/fuel conditioning apparatus for an engine includes an electromagnetic component configured to positively ionize fuel molecules of fuel supplied to the engine. The apparatus further includes an electrostatic component configured to negatively ionize air particles of air supplied to the engine. The oppositely ionized fuel molecules and air particles are mixed in a carburetor/fuel injection system of the engine.

In another aspect of the present invention, an exemplary fuel conditioning apparatus for an engine includes an electromagnetic component configured to positively ionize fuel molecules of fuel supplied to the engine. The ionized fuel molecules are mixed with air in a carburetor/fuel injection system of the engine.

In yet another aspect of the present invention, an exemplary air conditioning apparatus for an engine includes an electrostatic component configured to negatively ionize air molecules of air supplied to the engine. The ionized air molecules are mixed with fuel in a carburetor/fuel injection system of the engine.

These and other objects, advantages, purposes and features of the present invention will become apparent upon review of the following specification in conjunction with the drawings.

BRIEF DESCRIPTION OF THE DRAWINGS

FIG. 5A-5H are diagrams illustrating components and depicting their assembly to form an electromagnetic transducer of the electromagnet component of FIG. 2;

FIG. 9 is an exemplary parts list of the electrostatic circuit assembly of FIG. 3;

FIG. 10 is an exemplary parts list of the electromagnetic circuit assembly of FIG. 3; and FIG. 11 is an exemplary parts list of the voltage regulator circuit assembly of FIG. 3.

DESCRIPTION OF THE PREFERRED EMBODIMENTS

Embodiments of the present invention will now be described with reference to the accompanying figures, wherein numbered elements in the following written description correspond to like-numbered elements in the figures. Methods and a system of the present invention provide for a fuel and air conditioning apparatus for internal combustion engines ("engines") that improves engine efficiency by using dual technologies. That is, the simultaneous conditioning of both fuel and air particles (molecules) is an objective of the present invention. The fuel and air conditioning apparatus includes an electromagnetic component for positively ionizing fuel molecules and an electrostatic component for negatively ionizing air particles (molecules). When the two oppositely conditioned particles (molecules) are mixed in a carburetor/fuel injection system of the engine, a much higher combustion is achieved, and more fuel savings, higher power, and cleaner exhaust emissions can be achieved than through conventional devices using single technologies.

Figure 8:
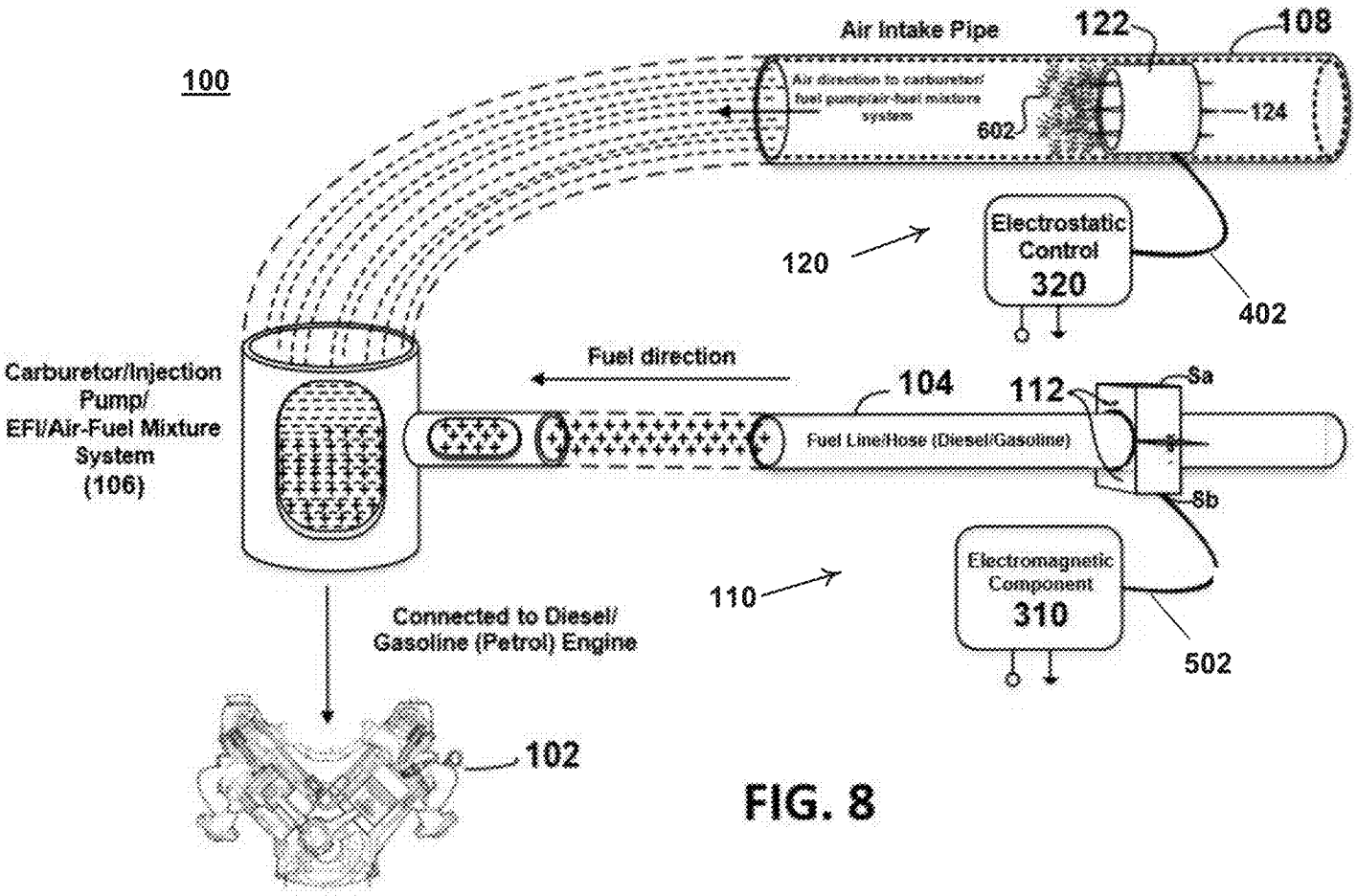
FIG. 8 illustrates the operation and installation of the electrostatic component of FIG. 1 and the electromagnetic component of FIG. 2 installed within an engine.

Referring now to the drawings and the illustrative embodiments depicted therein, an electromagnetic component 110 (FIG. 2) and an electrostatic component 120 (FIG. 1) are utilized together in a fuel and air conditioning apparatus 100 as shown in FIG. 8. Referring to FIG. 8, an electromagnetic transducer 112 of the electromagnetic component 110 is attached to a fuel line 104 before a carburetor/fuel injection assembly 106 of an engine 102. Electrostatic electrodes 122 of the electrostatic component 120 are installed inside an air induction system 108 of the engine 102 (see FIGS. 1 and 8). The electromagnetic component 110 positively ionizes the fuel molecules with a pulsing electromagnetic field in the range of 5-10 Hz to break down or cause to repel molecular clusters (fuel molecules of unspecified polarity) in the fuel, and thereby "atomizing" them. "Atomizing" is (to be understood as) ionizing fuel molecules to have the same polarity via a pulsing electromagnetic field, resulting in the fuel molecules repelling each other in liquid or vaporous form, such that the ionized fuel molecules would adhere more to the ionized air particles (molecules) than to other fuel molecules. When the fuel molecules are atomized, there will be less unburned fuel in the exhaust. Meanwhile, the electrostatic component 120 negatively ionizes the air particles (molecules) by a "corona discharge phenomena" 602 (see FIGS. 3 and 6). Because air particles are negatively ionized by the negative high voltage on the electrostatic electrodes 122 (e.g., a voltage equal to or more than −500V), the negatively ionized air particles will tend to repel each other. It is understood that the selected voltage is equal to or more than the absolute value of −500V, such as an exemplary −1,000V. The electromagnetic component 110 positively ionizes the fuel molecules and produces "cations," while the electrostatic component 120 negatively ionizes the air particles (molecules) producing "anions." When the fuel molecules with positive cations and the air particles with negative anions are fed to the carburetor/fuel injection system 106, these two oppositely charged elements will seek each other and will be thoroughly mixed (see FIG. 8). The opposite polarization of the two elements (air and fuel) will result in a higher level of mixing of the air and fuel (than conventional methods), resulting in higher rates of fuel combustion in the engine 102 (than conventional methods).

Conventional carburetor/fuel injection systems mix incoming neutrally charged fuel and air. As illustrated in FIG. 8, the exemplary electromagnetic component 110 and electrostatic component 120 would be installed together on the carburetor/fuel injection system 106 to achieve the highest possible level of fuel savings, power increase, and the cleanest emissions in order to avoid the potential pollution produced by engines with conventional carburetor/fuel injection systems.

Figure 1:
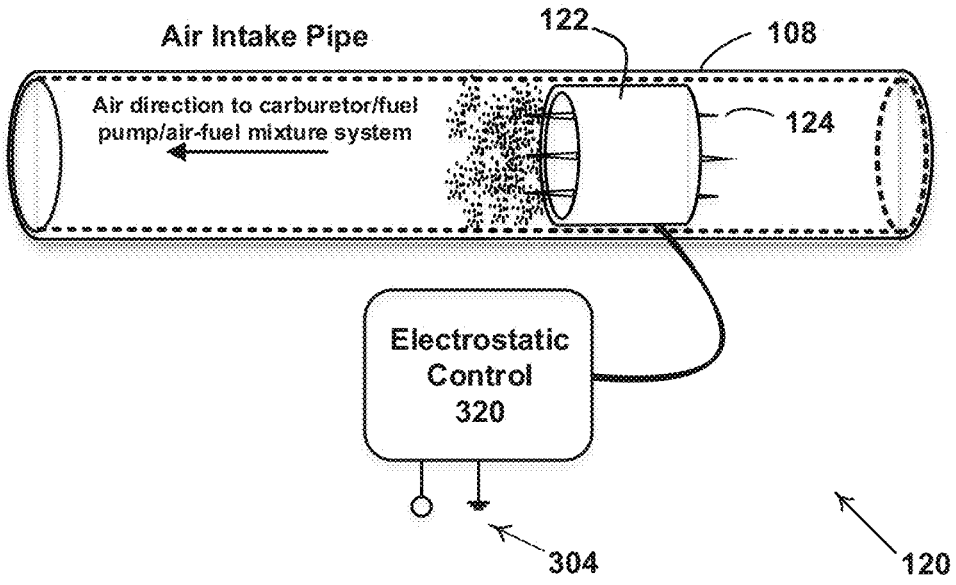
FIG. 1 is a perspective view of an electrostatic component in accordance with the present invention, shown in an air induction system.
Figure 3:
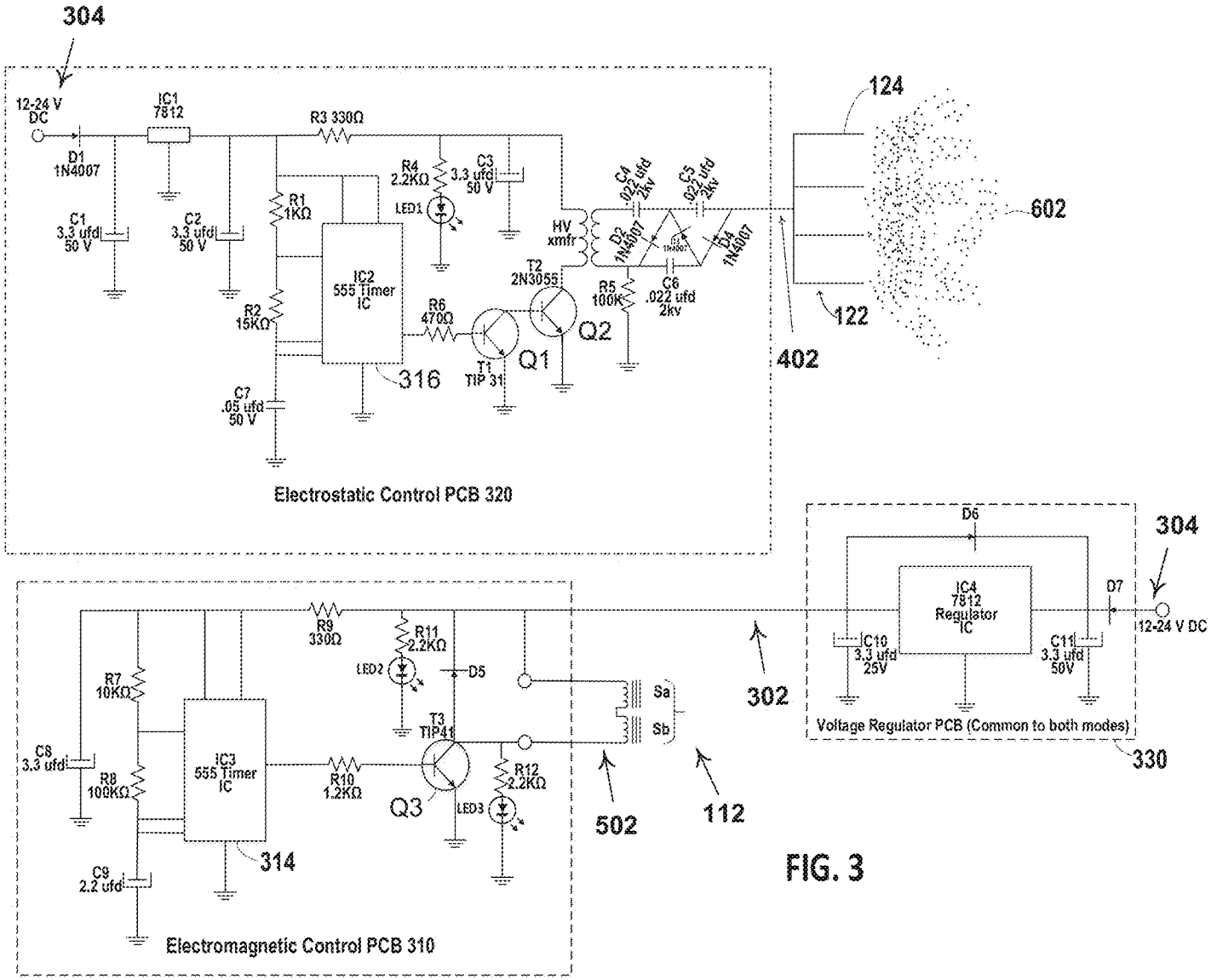
FIG. 3 is a schematic diagram of an exemplary electrostatic component, an exemplary electromagnetic component, and a voltage regulator in accordance with the present invention.

Referring to FIGS. 1 and 3, the electrostatic component 120 also includes an electrostatic control circuit assembly 320 that may be implemented as an exemplary electrostatic printed circuit board (PCB). The electrostatic control PCB 320 is configured to produce a high negative voltage output, which is used to negatively ionize air molecules. As illustrated in FIG. 3, a 555-type IC oscillator 316, operating at 5 kHz, outputs a signal to a TIP31-type voltage amplifier transistor Q1. The signal output from the voltage amplifier transistor Q1 (which steps up the signal to the required voltage level) is then fed to a 2N3055-type power amplifier transistor Q2. Diodes D2, D3, and D4 of the electrostatic control PCB 320 rectify the signal to a negative DC signal (such as a voltage equal to or more than −500V DC). This high negative voltage signal is present in the electrostatic electrodes 122. The electrostatic electrodes 122 include "needle-sharp" metal needles (e.g., sharpened needles) 124 which are installed in the air induction hose 108, e.g., after an air filter. For at least prototype purposes, the needles 124 may be formed from modified needles (e.g., sewing needles trimmed to a desired length), although it will be appreciated that sharpened purpose-built metal electrodes may be used. Alternatively, unsharpened electrodes may be used.

Figure 6:
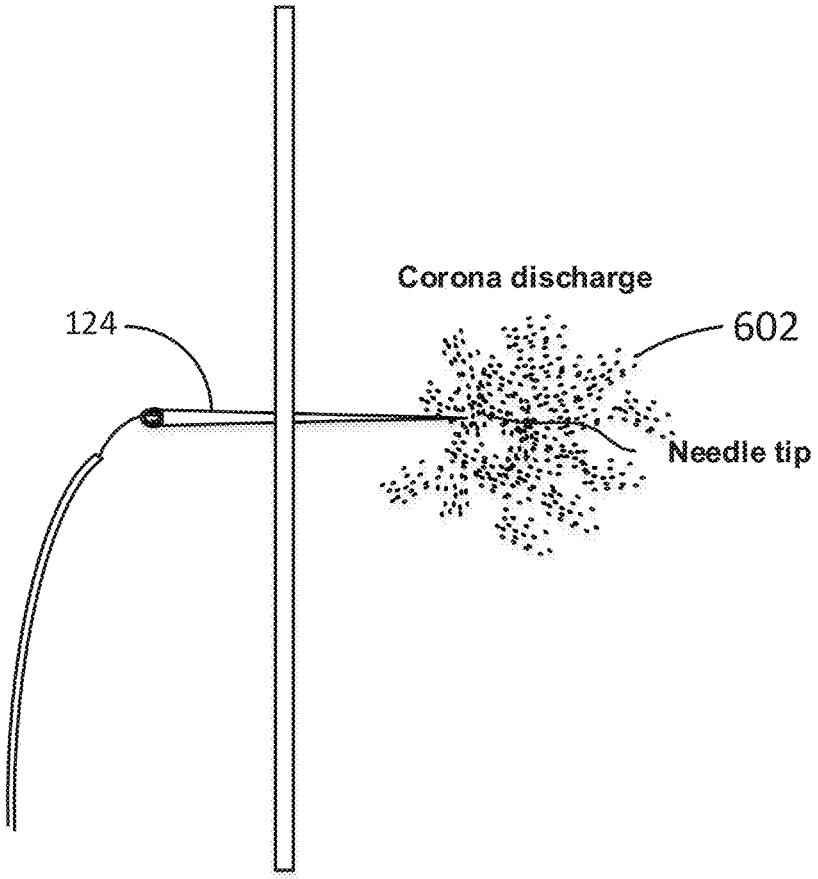
FIG. 6 illustrates an exemplary corona discharge associated with a needle of an electrostatic component in accordance with the present invention.

The phenomenon of the cloud of "corona discharge" 602 around the electrostatic electrode 122, which is illustrated in FIGS. 3 and 6, is due to the high negative voltage applied to the pointed tips of the needles 124 of the electrostatic electrodes 122. FIG. 6 illustrates an enlarged view of an electrode needle 124 and needle tip, showing the corona discharge phenomenon 602 on the tip of the needle 124 and the cloud of electrons that are forcefully emitted by the sharp point of the needle 124 into the surrounding air. Millions of electrons, which are inherently negatively charged, are forcefully emitted by the negatively charged needles 124 to the surrounding air, thus, the air particles or molecules acquire a more negative charge. When the negatively charged air particles (in the air induction hose 108) are mixed with the positively ionized fuel particles in the carburetor/fuel injection system 106, maximum mixing is achieved and a higher than normal combustion occurs.

Figure 2:
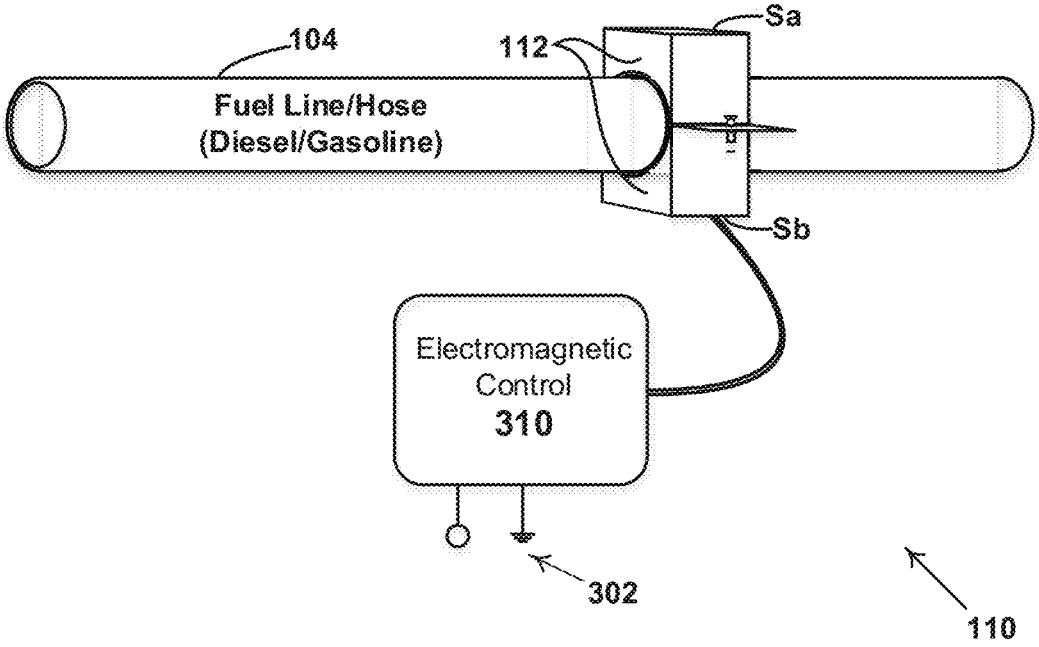
FIG. 2 is a perspective view of an electromagnet component in accordance with the present invention, shown clamped on a fuel line.

Referring to FIGS. 2 and 3, the electromagnetic component 110 is implemented as a set of exemplary annular bodies and an electromagnetic control PCB 310 comprising a 555-type IC oscillator 314 and a transistor power amplifier Q3. The electromagnetic control PCB 310 is connected to a ground connection and a positive battery supply. As illustrated in FIG. 3, the transducer member 112 (solenoids Sa and Sb) is connected to the oscillating and power amplifying circuits of the electromagnetic control PCB 310 and a voltage regulator PCB 330. The transducer member 112 is clamped to the fuel line 104 between a fuel filter (not shown) and the injection pump/carburetor 106 for engines 102 (see FIG. 8). To protect the electromagnetic control PCB 310, the electromagnetic control PCB 310 may be provided with an aluminum enclosure and a cover (not shown) and filled with an epoxy or resin encapsulation.

Referring to FIG. 3, the oscillator 314 operates at 5 to 10 Hz, and its output is amplified by transistor amplifier Q3 and is fed to the transducer assembly 112 (solenoids Sa and Sb). The transducer assembly 112 is clamped to the fuel line 104 and the pulsing magnetic field positively ionizes the fuel molecules as they flow down the fuel line 104 (and through the magnetic field produced by the transducer assembly 112 to the engine 102. When the negatively ionized air particles mix with the positively ionized fuel (in the carburetor/injection pump 106), maximum combustion (minimum unburned fuel) may be achieved.

While FIG. 3 illustrates a "common" voltage-regulated power supply PCB 330 (supplying power to both the electromagnetic component 110 and the electrostatic component 120), optionally, separate power supplies may be provided to the electromagnetic component 110 and the electrostatic component 120 in separate circuits and casings. In one exemplary embodiment, the electromagnetic control PCB 310 and the electrostatic control PCB 320 may be constructed as a single PCB with separate circuits, but with a single casing, or as separate PCBs with separate cases or arranged together in a single casing. The power supply PCB 330 (whether a common single unit or a pair of power supplies) may be arranged in the same casing(s) with the electromagnetic control PCB 310 and the electrostatic control PCB 320.

Fuel and Air Conditioning Apparatus Prototype:

Exemplary components of a prototype fuel and air conditioning apparatus (and the steps for its assembly) are illustrated in FIGS. 4 and 5, with those component parts listed in Tables I-III of FIGS. 9-11. Referring to FIG. 3, one to three specifically designed PCBs may be used. The number of PCBs is dependent on whether the electrostatic control PCB 320, the electromagnetic control PCB 310, and/or the power supply PCB 330 are arranged on separate PCBs or a single divided PCB. In an exemplary prototype, three pieces of single-sided PCB are selected that are each 33 mm×67 mm in dimension. A layout pattern is drawn using a pen or masking tape. After the PCBs have been laid out for etching, the PCBs are immersed in a container filled with an etchant solution, such as an acid (e.g., a plastic container half filled with ferric chloride). The container is agitated for 10-20 minutes until the etchant consumes the exposed copper foil on the PCB leaving the desired pattern. The etched PCBs are washed with running water and then let dry. Thereafter, appropriate holes in the PCB may be drilled.

Electrostatic Control PCB (320) Prototype:

Exemplary components of a prototype electrostatic control PCB 320 are illustrated in FIG. 3 and Table I of FIG. 9. The exemplary parts/components listed in Table I are inserted into the prototype electrostatic control PCB. The components may be soldered using point-to-point wiring techniques. When the components are soldered, and extra leads cut, the prototype electrostatic control PCB may be tested with a power supply (e.g., a 12-volt power supply). When power is supplied to the prototype electrostatic control PCB, a red LED light on the electrostatic control PCB will light, and a voltage equal to or more than −500 V DC will be present at the prototype electrostatic electrode 122. Thereafter, epoxy glue may be applied to the prototype electrostatic control PCB on the component side, and the prototype electrostatic control PCB then secured (e.g., glued) to a chassis.

Figure 4A:
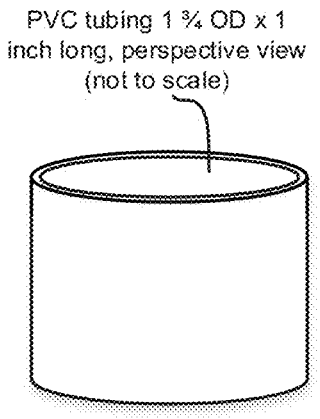
FIG. 4A-4D are diagrams illustrating components and depicting their assembly to form the electrostatic component of FIG. 1.
Figure 4B:
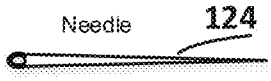
Figure 4C:
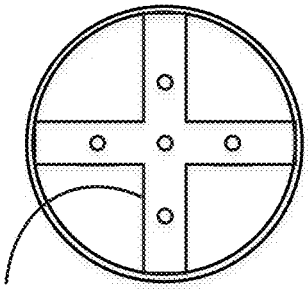
Figure 4D:
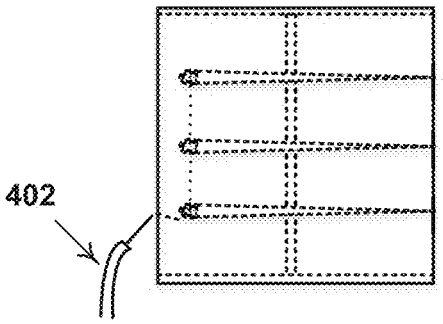

Electrostatic Electrode 122 Prototype:

Exemplary components of a prototype electrostatic electrode 122 are illustrated in FIGS. 4A-4D. An exemplary piece of 1¾ inch OD PVC tubing is cut to a prototype length of 1 inch (see FIG. 4A). Five large needles (e.g., sewing needles) are obtained and cut one inch from the tip (see FIG. 4B). While the illustrated prototype discussed herein utilizes sewing needles that are cut to a desired length, it is understood that the electrodes may be formed of other materials, such as purpose built electrode needles. Two pieces of phenolic board or any insulator board are cut to a prototype 1¾×1 inch, trimmed inside the PVC tubing, and glued with epoxy to form a cross in the center of the PVC tubing (see FIG. 4C). Thereafter, the assembly is glued with epoxy or other similar adhesive. Five holes are drilled in the phenolic or insulator board for the needles to pass through. Referring to FIG. 4D, once the needles are placed in the phenolic or insulator board, the needles are secured with epoxy/adhesive.

The five needles 124 are soldered to a wire 402 at a common point, such that the five needles 124 are electrically coupled to the wire 402 (see FIG. 4D). Thus, the wire 402 couples the electrostatic control PCB 320 to the electrostatic electrode 122 (see FIGS. 3, 4D, and 6). The prototype wire 402 is selected for handling a voltage equal to or more than −500 V DC output of the electrostatic control PCB 320. In the prototype assembly, the wire 402 is a No. 18 wire (e.g., a No. 18 yellow automotive wire).

Electromagnetic Control PCB 310 Prototype:

Exemplary components of a prototype electromagnetic control PCB 310 are illustrated in FIG. 3 and Table II of FIG. 10. Table II illustrates an exemplary list of components for the prototype electromagnetic control PCB. The components/parts listed in Table II are inserted into the prototype electromagnetic control PCB 310. The components may be soldered using point-to-point wiring techniques. Similar to the prototype electrostatic control PCB discussed above, once the parts listed in Table II (FIG. 10) are inserted in the electromagnetic control PCB 310, excess leads are removed/cut off. In one exemplary embodiment, an aluminum alloy case and cover is utilized. Thereafter, an epoxy glue or resin may be applied to the prototype electromagnetic control PCB 310 on the component side, and the electromagnetic control PCB secured (e.g., glued) to the chassis.

The assembled prototype electromagnetic control PCB 310 may be tested by temporarily connecting a 200-ohm, 1-watt resistor to the electromagnetic control PCB's output to act as a load. The prototype electromagnetic control PCB 310 is temporarily powered by (via a pair of wires, e.g., a set of red and black automotive wires) a 15V DC converter power supply. Note that the prototype electromagnetic control PCB 310 of FIG. 3 is polarity protected. A 100-milliamp meter is connected in series with the red wire. A current should be pulsing between 50 to 70 mA. The red LED of the prototype electromagnetic control PCB 310 should have a steady light, while the green LED should flash (not flicker) at the rate of 5 to 10 flashes per second.

Figure 5E:
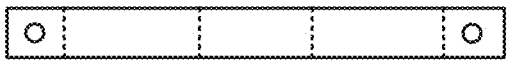
Figure 5F:
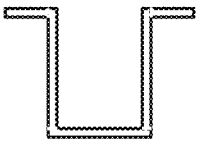
Figure 5G:
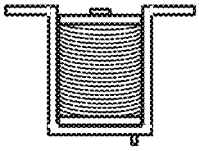

Electromagnetic Transducer 112 Prototype:

Exemplary components (and their conversion) of a prototype electromagnetic transducer 112 are illustrated in FIGS. 5A-5H. As illustrated in FIG. 5A-5H, two 6-Volt relays are adapted to assemble the prototype electromagnetic transducer 112. The prototype conversion is illustrated with an exemplary 6V relay (e.g., an UYD 110P relay). As illustrated in FIGS. 5B and 5C, the plastic housing, contacts, and armature are removed from the relay. The coils have a total resistance of 200 ohms. With a PVC pipe cutter, a length of 1-inch diameter PVC pipe is cut to an exemplary 7/8 inches long. Referring to FIG. 5E, a metal sheet is cut into a prototype strip, 105 mm long×10 mm wide×1 mm thick. Referring to FIG. 5F, the metal strip is bent to fit the prototype coil inside, as illustrated in FIG. 5G. Two of these prototype coil assemblies are prepared. For the prototype, an exemplary six-inch-long, No. 18 twin wire 504 is soldered to one coil (e.g., the Sb coil), which forms a series wire that is then soldered to the opposite coil (e.g., the Sa coil) to connect them in series (see FIG. 5H). Next, an exemplary 2-foot-long No. 18 twin wire 502 (e.g., a No. 18 black wire) is soldered to the Sb coil.

Figure 5H:
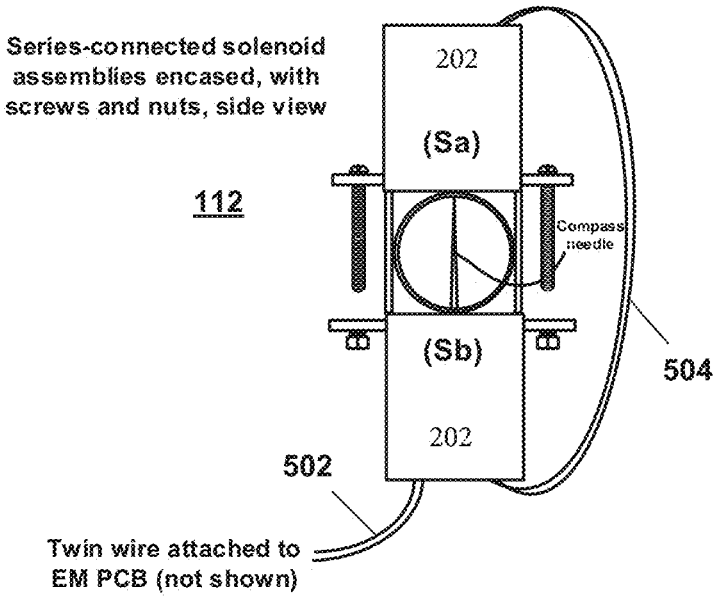
Figure 7:
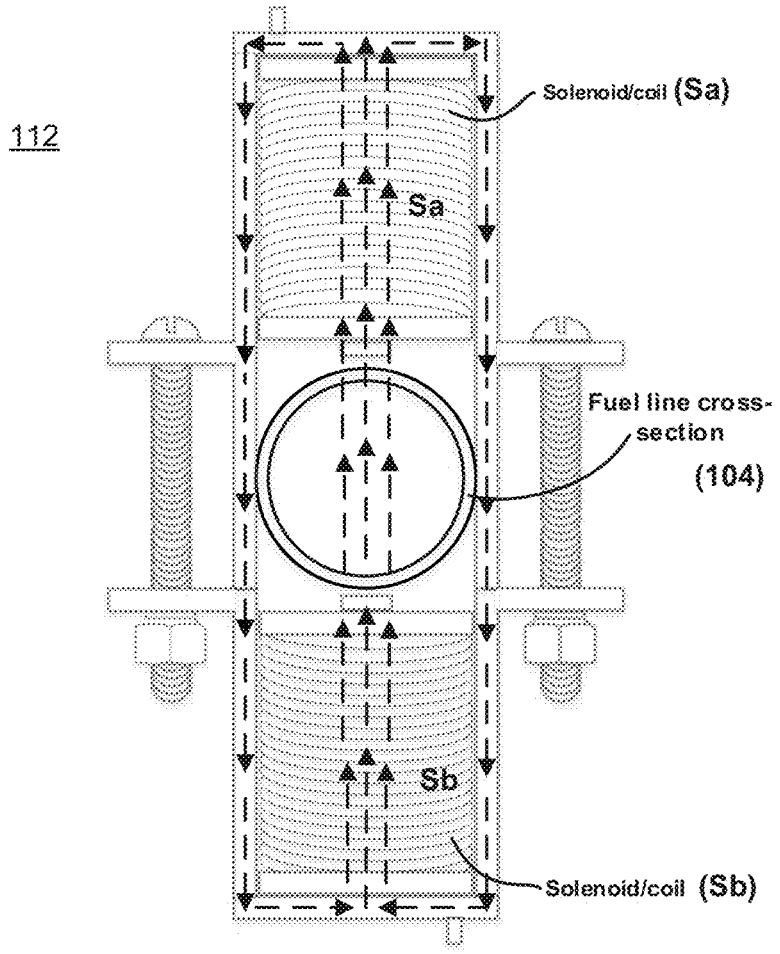
FIG. 7 is a cross-sectional view of the electromagnet component in accordance with the present invention, shown installed about a fuel line.

As illustrated in FIG. 5H, each prototype coil/metal strip is pushed gently inside its respective PVC tubing. To test if the solenoids/coils (Sa, Sb) are series-aiding, place a small compass between the two solenoids (Sa, Sb) and apply a DC power supply (9V) (see FIG. 5H). Observe the compass needle; it should point towards the solenoids (Sa, Sb) as illustrated in FIG. 5H. If not, invert the prototype wire connections of one of the solenoids/coils (Sa, Sb). Inverting the polarity of the power supply should cause the compass needle to point to the other direction. FIG. 7 is a cross-sectional view of the pair of prototype solenoids (Sa, Sb) clamped around an exemplary fuel line. FIG. 7 provides an enlarged view of the transducer assembly 112 with a soft iron reluctance path, which concentrates the electromagnetic field (arrowed path) within minimum stray electromagnetic energy.

When the exemplary wires are soldered, an epoxy or resin may be applied to seal the coil inside the PVC tubing of the prototype assembly. Thus each coil (SA, Sb) is sealed within a respective vinyl housing 202 (see FIG. 5H). In one embodiment, the prototype coil assembly has waterproof integrity. When the epoxy or resin dries, the assembly may be painted with black acrylic paint. As illustrated in FIG. 5E, holes are drilled on either end of the metal strips. These holes are used to hold the two assemblies (Sa and Sb) together with anodized stove bolts (½ to ¾ inch long) (see FIG. 7). The prototype assembly provides a closed core loop around the fuel line, resulting in low energy loss.

Voltage Regulator PCB Prototype:

Exemplary components of a prototype voltage regulator PCB 330 are illustrated in FIG. 3 and Table III in FIG. 11. The prototype assembly includes a small piece of universal PCB cut to an exemplary 1"×1" square. Into the 1×1 inch square PCB, the voltage regulator components, illustrated in Table III and FIG. 3, are installed. After installation, the parts are soldered, and excess wires are cut. As illustrated in FIGS. 1-3, the voltage regulator PCB 330 is coupled to the electromagnetic control PCB 310 via hook-up wires 302, and coupled to the electrostatic control PCB 320 via hook-up wires 304.

The electrostatic control PCB 320, the electromagnetic control PCB 310, and the power supply PCB 330 assemblies are arranged in alloy or thermoplastic housings or covers. As discussed herein, the above assemblies may also be arranged into separate housings, or two or more of them arranged in a common housing.

Embodiments of the present invention are intended primarily for Euro 2 engines due to their simpler design. While embodiments of the present invention may be used with Euro 4 engines, the Euro 4 engines may require ECU (re)programming.

One practical application of the above-described dual technology system is on two-stroke engines, where the fuel and lube oil are together subjected to the above described electromagnetic energy while the air is applied with electrostatic energy. This is much cheaper and more effective than retrofits and/or LPG conversion kits. Users of single technology systems will appreciate dual technology devices wherein the dual technologies complement each other in the enhancement of combustion in engines (the two technologies aid each other). This means more fuel economy, more engine power, and cleaner smoke emissions than single technology applications. The application of embodiments of the present invention can greatly improve the efficient use of fuels and fuel supplies, local and gasoline/diesel oil imports, in terms of lessening fuel costs for the same mileage.

Changes and modifications in the specifically described embodiments can be carried out without departing from the principles of the present invention, which is intended to be limited only by the scope of the appended claims, as interpreted according to the principles of patent law including the doctrine of equivalents.

The invention claimed is:

1. A fuel conditioning apparatus for an engine, the apparatus comprising an electromagnetic component configured to positively ionize fuel molecules of fuel supplied to the engine, wherein the ionized fuel molecules are mixed with air in a carburetor/fuel injection system of the engine;

wherein the electromagnetic component comprises first and second solenoids, each configured to produce a magnetic field, wherein the first solenoid is positioned on a fuel hose of the engine upstream of the carburetor/fuel injection system, and wherein the second solenoid is positioned on the fuel hose opposite the first solenoid.

2. The apparatus of claim 1, wherein the electromagnetic component is configured to produce a magnetic field such that incoming fuel molecules are made positively charged before entry into the carburetor/fuel injection system.

3. The apparatus of claim 2, wherein the electromagnetic component is configured to output a 5 pulses/sec signal to the first and second solenoids.

4. The apparatus of claim 2, wherein the electromagnet component comprises a vinyl housing, and wherein the first and second solenoids are enclosed within the vinyl housing for waterproofing.

5. The apparatus of claim 1, wherein the electromagnetic component comprises an electromagnetic control PCB arranged in an aluminum or thermoplastic case with a cover and encapsulated with epoxy.

6. The apparatus of claim 1, further comprising a voltage-regulated power supply, wherein the electromagnetic component is coupled to the voltage-regulated power supply.

7. An air conditioning apparatus for an engine, the apparatus comprising an electrostatic component configured to negatively ionize air molecules of air supplied to the engine, wherein the ionized air molecules are mixed with fuel in a carburetor/fuel injection system of the engine;

wherein the electrostatic component comprises an electrode assembly arranged to extend longitudinally down the inside of an air induction hose of the engine, and wherein the electrode assembly comprises a plurality of parallel needles, wherein passing air molecules in the air induction hose receive a negative charge from the parallel needles.

8. The apparatus of claim 7, wherein the air conditioning apparatus is positioned upstream of the carburetor/fuel system, such that incoming air in the air induction hose is negatively charged before entry into the carburetor/fuel injection system.

9. The apparatus of claim 7, wherein the electrostatic component comprises an electrostatic control PCB arranged in a metal or thermoplastic case with a cover and encapsulated with epoxy.

10. The apparatus of claim 7 further comprising a voltage-regulated power supply, wherein the electrostatic component is coupled to the voltage-regulated power supply.

11. An air/fuel conditioning apparatus for an engine, the apparatus comprising:

an electromagnetic component configured to positively ionize molecules of fuel supplied to the engine, wherein the electromagnetic component comprises first and second solenoids, each configured to produce a magnetic field, wherein the first solenoid is positioned on a fuel hose of the engine upstream of a carburetor/fuel injection system of the engine, and wherein the second solenoid is positioned on the fuel hose opposite the first solenoid; and an electrostatic component configured to negatively ionize molecules of air supplied to the engine;

wherein oppositely ionized fuel molecules and air molecules are mixed in the carburetor/fuel injection system.

12. The apparatus of claim 11, wherein the electromagnetic component is configured to produce a magnetic field such that incoming fuel molecules are made positively charged before entry into the carburetor/fuel injection system.

13. The apparatus of claim 12, wherein the electromagnetic component is configured to output a 5 pulses/sec signal to the first and second solenoids.

14. The apparatus of claim 12, wherein the electromagnetic component comprises a vinyl housing, and wherein the pair of solenoids are enclosed within the vinyl housing for waterproofing.

15. The apparatus of claim 11, wherein the electromagnetic component comprises an electromagnetic control PCB arranged in an aluminum case with a cover and encapsulated with epoxy.

16. The apparatus of claim 11, wherein the electrostatic component comprises an electrode assembly, and wherein the electromagnetic component is configured to output a voltage signal equal to or more than −500 V to the electrode assembly.

17. The apparatus of claim 16, wherein the electrode assembly is arranged to extend longitudinally down the inside of an air induction hose of the engine such that incoming air is made negatively charged before entry into the carburetor/fuel injection system, and wherein the electrode assembly comprises a plurality of parallel needles such that passing air molecules in the air induction hose receive a negative charge.

18. The apparatus of claim 16, wherein the electrostatic component comprises an electrostatic control PCB arranged in a metal case with a cover and encapsulated with epoxy.

19. The apparatus of claim 11, wherein the electromagnetic component and the electrostatic component each comprise a respective voltage-regulated power supply.

20. The apparatus of claim 11, further comprising a voltage-regulated power supply, wherein the electromagnetic component and the electrostatic component are coupled to the voltage-regulated power supply.

* * * * *